US008091246B2

(12) United States Patent
Hepburn

(10) Patent No.: US 8,091,246 B2
(45) Date of Patent: Jan. 10, 2012

(54) CASING OR WORK STRING ORIENTATION INDICATING APPARATUS AND METHODS

(75) Inventor: Neil Hepburn, Sola (NO)

(73) Assignee: Halliburton Energy Services, Inc., Houston, TX (US)

( * ) Notice: Subject to any disclaimer, the term of this patent is extended or adjusted under 35 U.S.C. 154(b) by 256 days.

(21) Appl. No.: 12/027,460

(22) Filed: Feb. 7, 2008

(65) Prior Publication Data

US 2009/0199419 A1 Aug. 13, 2009

(51) Int. Cl.
*E21B 47/024* (2006.01)

(52) U.S. Cl. ..... 33/301; 33/313

(58) Field of Classification Search ..... 33/301, 33/302, 306, 307, 313; 73/152.29, 152.46, 73/152.18, 37
See application file for complete search history.

(56) References Cited

U.S. PATENT DOCUMENTS 3,983,948 A * 10/1976 Jeter ..... 33/306
4,351,116 A * 9/1982 Scott, Jr. ..... 33/307
4,852,262 A * 8/1989 Babcock et al. ..... 33/543.1
6,588,116 B2 * 7/2003 Dallas et al. ..... 33/313

OTHER PUBLICATIONS

Halliburton FlexRite Multilateral System, "Basic Operational Sequence," product brochure, 11 pages, undated.
Sperry-Sun Drilling Services, "Report on the Casing Orientation System," product brochure, 2 pages, undated.

* cited by examiner

*Primary Examiner* — Yaritza Guadalupe-McCall
(74) *Attorney, Agent, or Firm* — Marlin R. Smith

(57) ABSTRACT

Casing or work string orientation indicating apparatus and methods. A system for indicating orientation of a structure in a wellbore includes an orientation indicating device responsive to fluid flow through the device, whereby fluid flow through the device at a selected flow rate produces a reduced pressure differential across the device when the device is at a preselected azimuthal orientation, compared to an increased pressure differential across the device produced by fluid flow through the device at the selected flow rate when the device is not at the azimuthal orientation. A method of detecting orientation of a structure in a wellbore includes the steps of: flowing fluid at a selected flow rate through an orientation indicating device interconnected to the structure; and observing a substantially constant pressure differential across the device during the flowing step, thereby indicating that the structure is at a predetermined azimuthal orientation.

17 Claims, 9 Drawing Sheets

CASING OR WORK STRING ORIENTATION INDICATING APPARATUS AND METHODS

BACKGROUND

The present disclosure relates generally to equipment utilized and operations performed in conjunction with a subterranean well and, in an embodiment described herein, more particularly provides casing or work string orientation indicating apparatus and methods.

In order to allow accurate azimuthal orientation of a structure (such as a pre-milled casing window, orienting latch profile, production assembly, etc.) in a wellbore, prior orienting systems have typically relied on use of MWD tools or other pressure pulsing orientation indicating devices. Unfortunately, at increased depths, such pressure pulses are increasingly attenuated when the return flow path is restricted (such as, in an annulus between an inner work string and an outer casing or liner string), and pressure "noise", is introduced due to varied restrictions to flow in the return flow path. These conditions make pressure pulses and data transmitted by pressure pulses difficult to detect and interpret at the surface.

Furthermore, typical MWD tools cannot be cemented through, are too valuable to be drilled through, and do not provide for passage of plugs therethrough for releasing running tools, setting hangers and packers, etc. If an MWD tool must be separately conveyed and retrieved from a well, additional time and expense are required for these operations. In addition, conveyance of MWD tools into very deviated or horizontal wellbores by wireline or pumping the tools down presents additional technical difficulties.

Therefore, it may be seen that improvements are needed in the art of indicating orientation of structures in a wellbore.

SUMMARY

In the present specification, an orientation indicating device and associated systems and methods are provided which solve at least one problem in the art. One example is described below in which an orientation system does not require use of MWD tools or transmission of pressure pulses to indicate orientation of a downhole structure. Another example is described below in which the orientation indicating device can be cemented through and drilled through when interconnected as part of a casing or liner string. When interconnected as part of a work string, the device can be conveyed into and retrieved from a well with the work string, while permitting a plug to be dropped through the device to, for example, set a packer or hanger, release a running tool, etc.

In one aspect, a system for indicating orientation of a structure in a subterranean wellbore is provided by the present disclosure. The system includes an orientation indicating device responsive to fluid flow through the device. Fluid flow through the device at a selected flow rate produces a reduced pressure differential across the device when the device is at a preselected azimuthal orientation, as compared to an increased pressure differential across the device produced by fluid flow through the device at the selected flow rate when the device is not at the azimuthal orientation.

In another aspect, a method of detecting orientation of a structure in a subterranean wellbore is provided. The method includes the steps of: flowing fluid at a selected flow rate through an orientation indicating device interconnected to the structure; and observing a substantially constant pressure differential across the device during the flowing step, thereby indicating that the structure is at a predetermined azimuthal orientation.

These and other features, advantages, benefits and objects will become apparent to one of ordinary skill in the art upon careful consideration of the detailed description of representative embodiments hereinbelow and the accompanying drawings, in which similar elements are indicated in the various figures using the same reference numbers.

BRIEF DESCRIPTION OF THE DRAWINGS

FIG. 3 is a schematic cross-sectional view of the system, in which the orientation indicating device is being drilled through;

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface relative to a wellbore, and "below", "lower", "downward" and similar terms refer to a direction away from the earth's surface relative to the wellbore.

Figure 1:
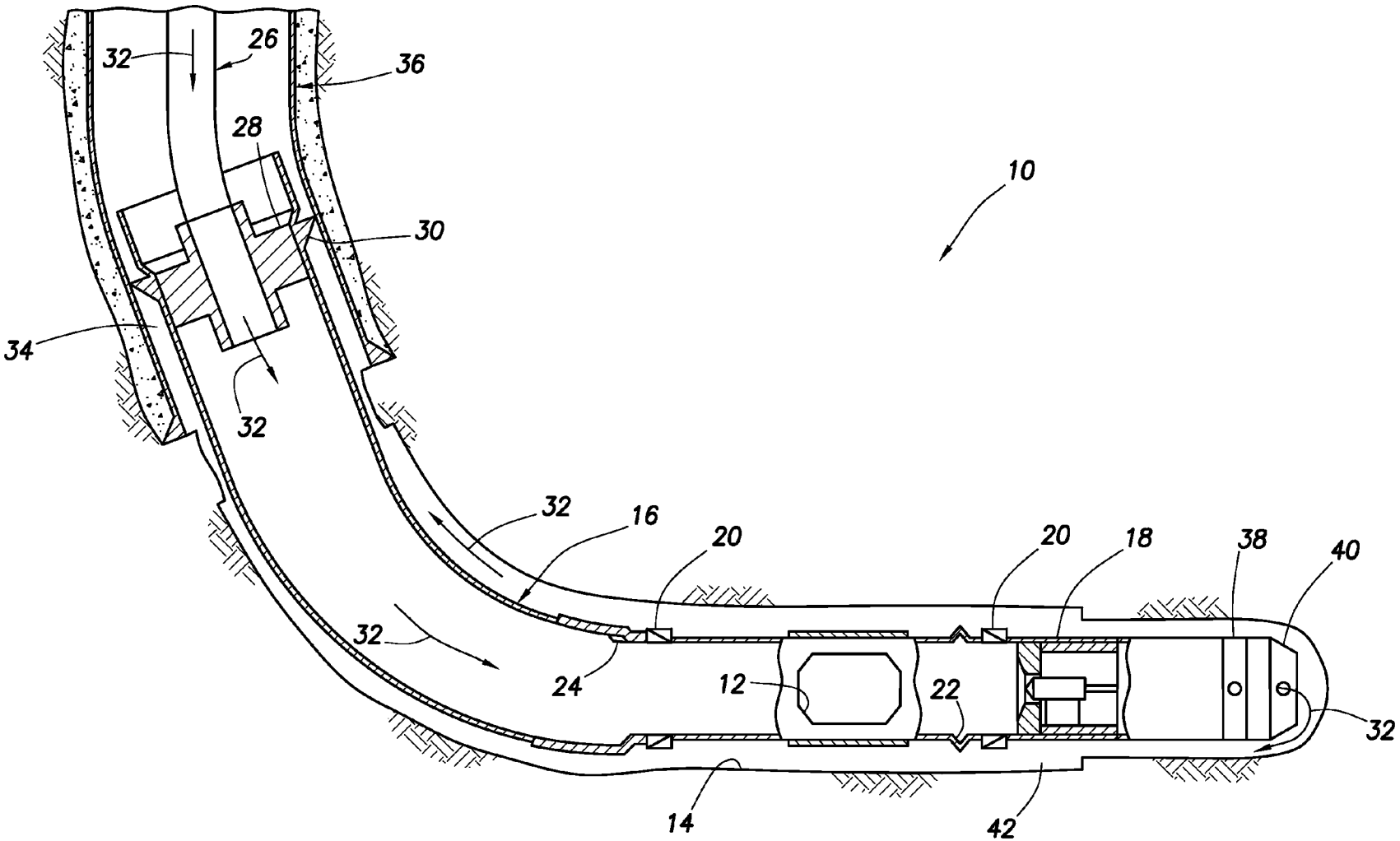
FIG. 1 is a schematic cross-sectional view of a casing string orientation system and method which embody principles of the present disclosure, an orientation indicating device of the system being in a relatively more flow restricting configuration.

Representatively illustrated in FIG. 1 is a system 10 and associated method for indicating orientation of a structure 12 in a very deviated subterranean wellbore 14, which system and method embody principles of the present disclosure. The structure 12 is a window for use in drilling a branch wellbore to intersect the wellbore 14, but orientation of other types of structures may be achieved in keeping with the principles of the present disclosure.

In the system 10, it is desired to azimuthally orient the window 12 relative to the wellbore 14. As depicted in FIG. 1, the wellbore 14 is substantially horizontal, but the wellbore could be otherwise deviated from vertical.

The desired orientation of the window 12 in this example is vertically upward relative to the wellbore 14. The window 12 is interconnected in a tubular string 16 (such as a liner string), and so the tubular string is to be rotated within the wellbore 14 until it is oriented so that the window faces vertically upward.

However, it should be understood that orientations of structures other than vertical can also be accomplished in keeping with the principles of the present disclosure. For example, the window 12 could be oriented in a downward direction, or any other direction, if desired, by merely adjusting an azimuthal alignment between the window and an orientation indicating device 18, which is also interconnected as part of the tubular string 16.

In the example of FIG. 1, this azimuthal alignment is accomplished prior to conveying the tubular string 16 into the wellbore 14 by means of an alignment device 20 interconnected in the tubular string between the window 12 and the orientation indicating device 18. Adjustment of azimuthal alignment between the device 18 and any structure to be oriented in the wellbore 14 can be accomplished by other means, as well, such as by use of an alignment adjusting device as part of the orientation indicating device, or as part of the structure to be oriented, etc.

Structures other than the window 12 may additionally, or alternatively, be oriented relative to the wellbore 14 by use of the orientation indicating device 18. For example, another structure 22 to be oriented could be a latch profile of the type used to anchor and orient subsequently installed milling and drilling whipstocks and deflectors.

Yet another structure 24 to be oriented could be an alignment tool used to orient and position subsequently installed completion equipment relative to the window 12, wellbore 14 and/or tubular string 16. Another alignment device 20 may be used to azimuthally orient the structure 24 relative to the device 18 and the structure 12 and/or 22 prior to, or during, installation of the tubular string 16 in the wellbore 14.

As depicted in FIG. 1, a tubular work string 26 is being used to convey the tubular string 16 into the wellbore 14. At a lower end of the work string 26 is a setting tool 28 used to set a hanger 30 at an upper end of the tubular string 16.

Prior to sealing off an annulus 34 between the hanger 30 and a casing or liner string 36 extending toward the surface, fluid 32 can be circulated through the work string 26, through the tubular string 16, through a cementing float valve 38 and casing shoe 40 at a lower end of the tubular string 16, into an annulus 42 between the tubular string 16 and the wellbore 14, and via the annulus 34 to the surface. For reasons that will be explained more fully below, the orientation indicating device 18 is preferably the most restrictive portion of this circulation path for the fluid 32.

A relative pressure differential across the device 18 while the fluid 32 is being circulated through the tubular string 16 can be easily observed at a remote location, such as the earth's surface or a subsea wellhead. For example, one or more pressure gauges (not shown) may be used to monitor pressure applied to the work string 26 and pressure in the casing string 36 at the remote location.

In a preferred method of using the device 18, a decrease in the pressure differential across the device at a certain rate of flow of the fluid 32 is observed as an indication that a desired azimuthal orientation of the structure 12, 22 and/or 24 has been achieved. The work string 26 can be used to rotate the tubular string 16 in the wellbore 14 until the reduced pressure differential is observed, at which point the rotation may be ceased, or further rotation may be used if desired to achieve a certain orientation of the structure 12, 22 and/or 24.

It is not necessary in the method for the fluid 32 to be continuously flowed through the tubular string 16, or for the tubular string to be rotated while the fluid is flowed through the tubular string. Preferably, circulation of the fluid 32 is ceased while the tubular string 16 is rotated and then, after rotating the tubular string an incremental amount, circulation is restarted and the differential pressure across the device 18 is observed to see if the desired orientation has been achieved. If not, then the process of ceasing circulation, rotating the tubular string 16 and resuming circulation is repeated, until the desired orientation has been achieved.

Figure 2:
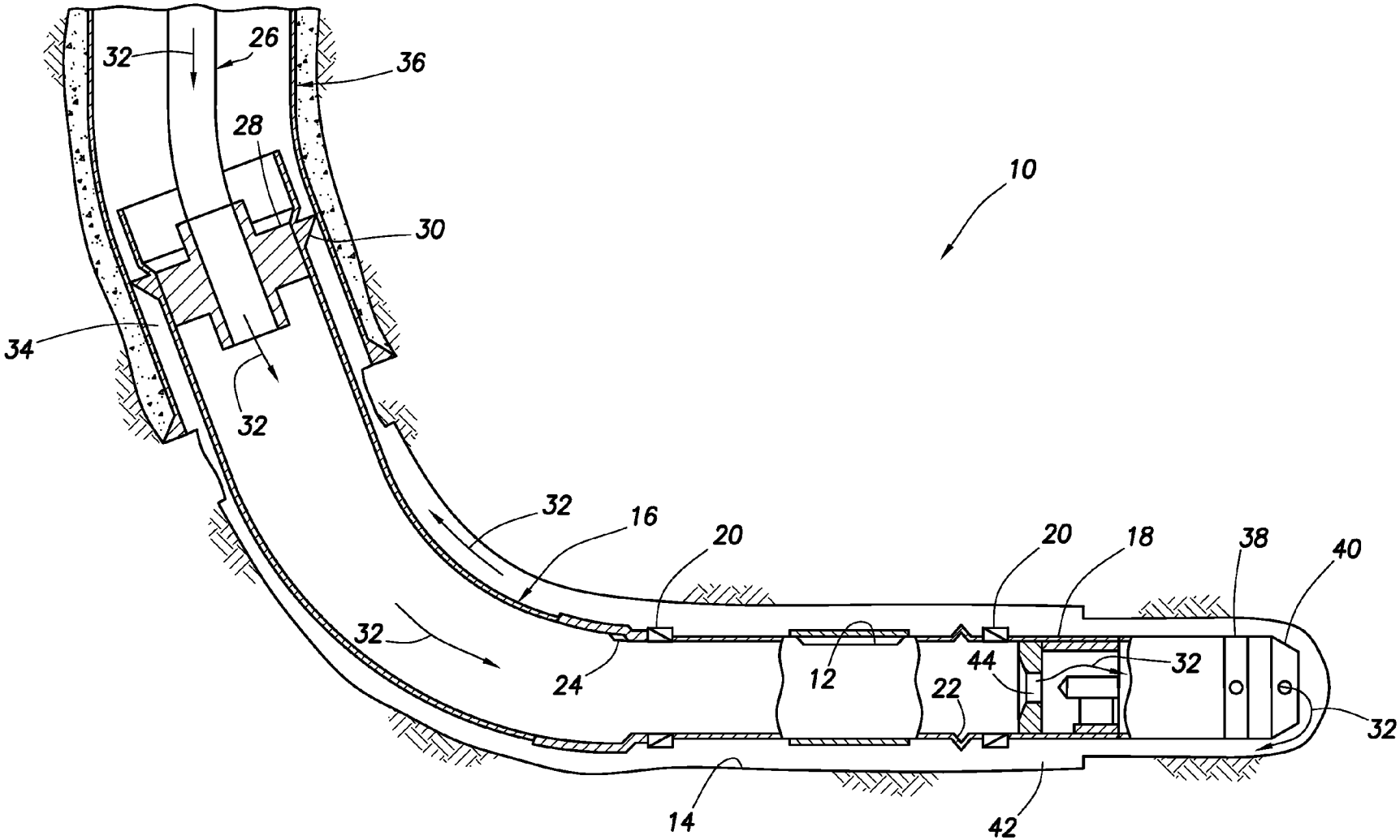
FIG. 2 is a schematic cross-sectional view of the system, in which the orientation indicating device is in a relatively less flow restricting configuration.

Referring additionally now to FIG. 2, the system 10 is representatively illustrated after the tubular string 16 has been rotated to the desired orientation of the structure 12, and with the fluid 32 being circulated through the tubular string. In this configuration, the pressure differential across the device 18 is significantly reduced (at the same flow rate of the fluid 32 as in the FIG. 1 configuration), and this reduced pressure differential is observed at the remote location as a positive indication that the desired orientation has been achieved.

The reduced pressure differential may indicate that more than one structure is at a desired orientation. In FIG. 2, all of the structures 12, 22, 24 are at a desired orientation when the pressure differential across the device 18 is reduced.

Note that the flow area of a flow passage 44 extending through the device 18 is significantly increased in the configuration of FIG. 2. This increased flow area contributes to the reduced pressure differential observed across the device 18 as an indication of the desired orientation, and also produces other substantial benefits in the system 10.

For example, the increased flow area permits a cement slurry to be flowed through the device 18. Thus, the device 18 does not have to be removed from the tubular string 16 or drilled through prior to cementing the tubular string in the wellbore 14. This is a significant operational and time-saving benefit of the system 10.

Furthermore, the increased flow area through the device 18 can permit objects, such as plugs, balls, etc., to pass through the device in order to actuate tools below the device. This can be a significant benefit in situations (such as the ones illustrated in FIGS. 8 & 9) in which pressure operated tools can be positioned below the device 18 and are responsive to plugs, etc. circulated to the tools.

Figure 3:
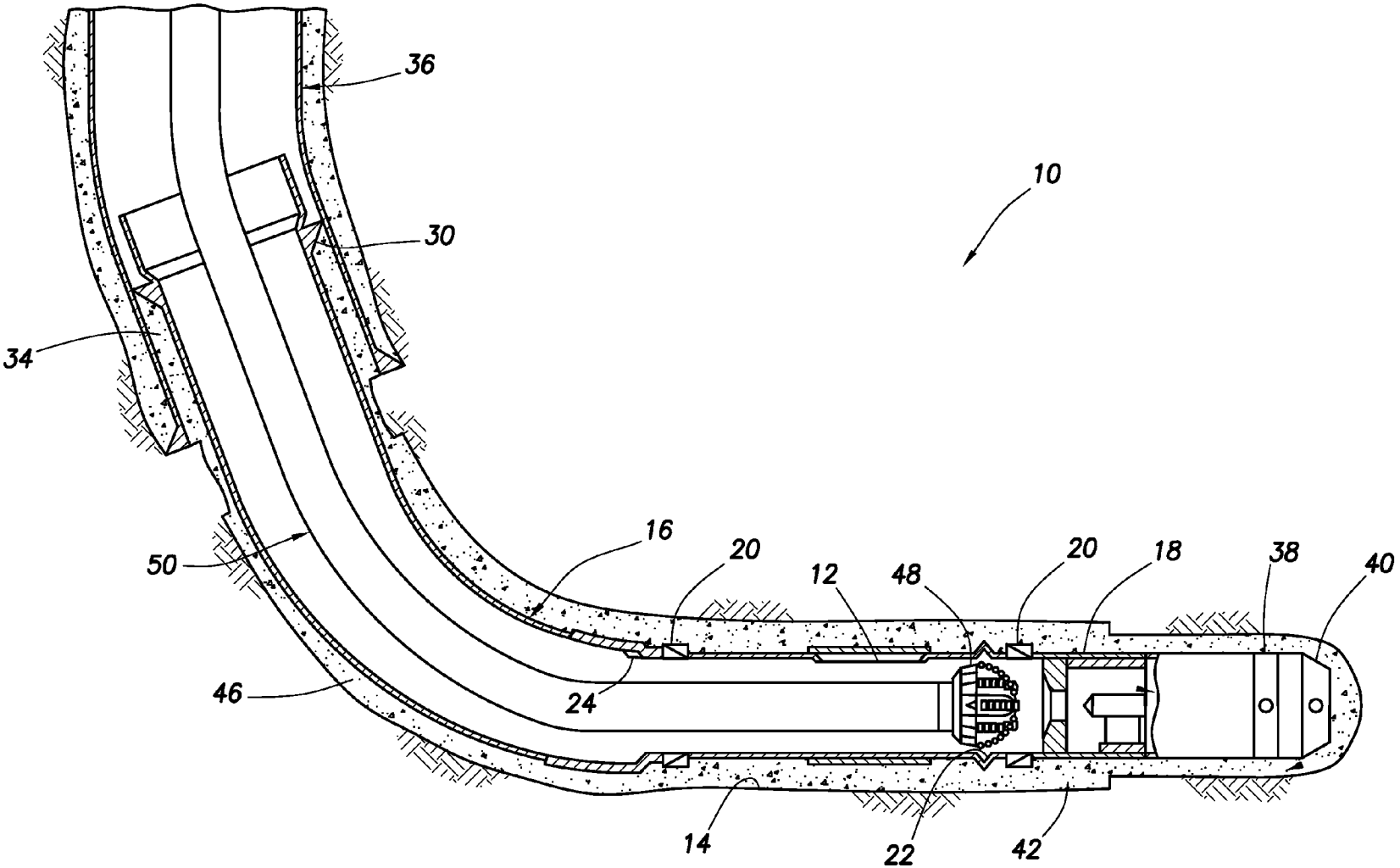

Referring additionally now to FIG. 3, the system 10 is representatively illustrated after the tubular string 16 has been cemented in the wellbore 14. Cement 46 is now present in the annulus 42, and in the annulus 34, and the hanger 30 has been set in the casing string 36. Note that the cement 46 has been flowed through the device 18, without a need to remove the device from the tubular string 16.

As depicted in FIG. 3, a drill bit 48 is being conveyed by a drill string 50, and is being used to drill through the device 18, cementing valve 38 and casing shoe 40 in order to extend the wellbore 14. It is a particular benefit of the device 18 that its internal components are preferably made of relatively easily drillable and non-magnetic materials (such as aluminum, elastomers, plastics, composites, etc.), so that extension of the wellbore 14 can be readily accomplished, and so that the resulting debris can be readily circulated out of the wellbore. However, if drilling through the device 18 is not required (such as in the embodiments of FIGS. 7-9), then the internal components of the device may not be made of easily drillable or non-magnetic materials.

Figure 4:
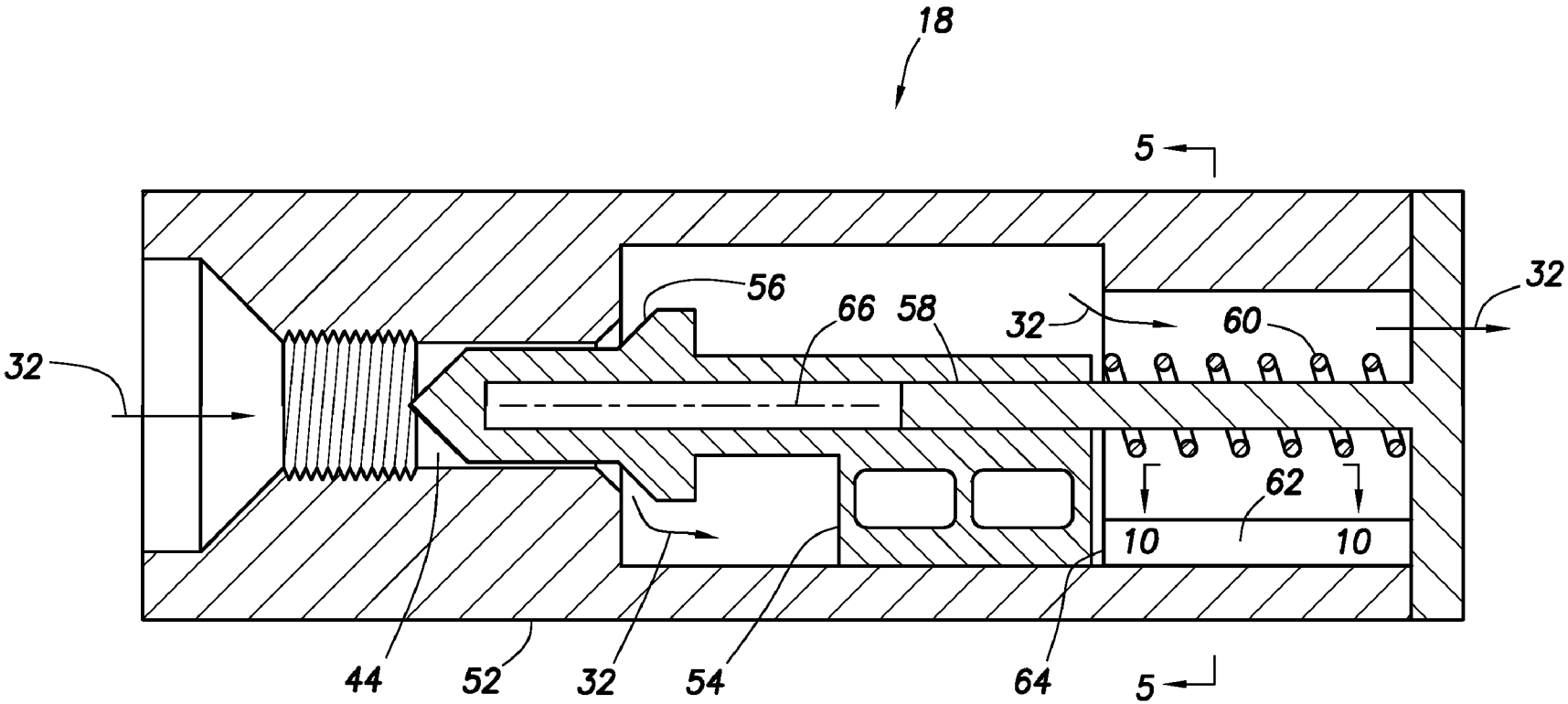
FIG. 4 is an enlarged scale schematic cross-sectional view of the orientation indicating device in the relatively more flow restricting configuration.

Referring additionally now to FIG. 4, an enlarged scale cross-sectional view of the orientation indicating device 18 is schematically and representatively illustrated. Although not shown in FIG. 4, an outer housing assembly 52 of the device 18 would preferably be provided with threaded ends for interconnecting in the tubular string 16 when used in the system 10 of FIGS. 1-3. Of course, the device 18 can be used in other systems and methods in keeping with the principles of the present disclosure.

The device 18 further includes an eccentric weight 54, a flow restrictor 56, a spindle 58, a biasing device 60 and a longitudinally extending recess 62 formed in the housing assembly 52. Although the eccentric weight 54 and flow restrictor 56 are depicted as being a single integrally formed element of the device 18, they could be separately formed if desired.

The eccentric weight 54 and flow restrictor 56 are reciprocably disposed on the spindle 58, and the biasing device 60 exerts a biasing force which tends to displace the flow restrictor in a direction reducing the flow area through the passage 44. Flow of the fluid 32 through the passage 44 in the direction indicated in FIG. 4 tends to displace the flow restrictor 56 in an opposite direction (to the right as viewed in FIG. 4) against the biasing force exerted by the biasing device 60.

However, the flow restrictor 56 and eccentric weight 54 cannot displace to increase the flow area through the passage 44, unless the eccentric weight is aligned with the recess 62. If the eccentric weight 54 is not aligned with the recess 62, the eccentric weight will engage a shoulder 64 in the housing assembly 52, thereby preventing rightward displacement of the eccentric weight.

Figure 5:
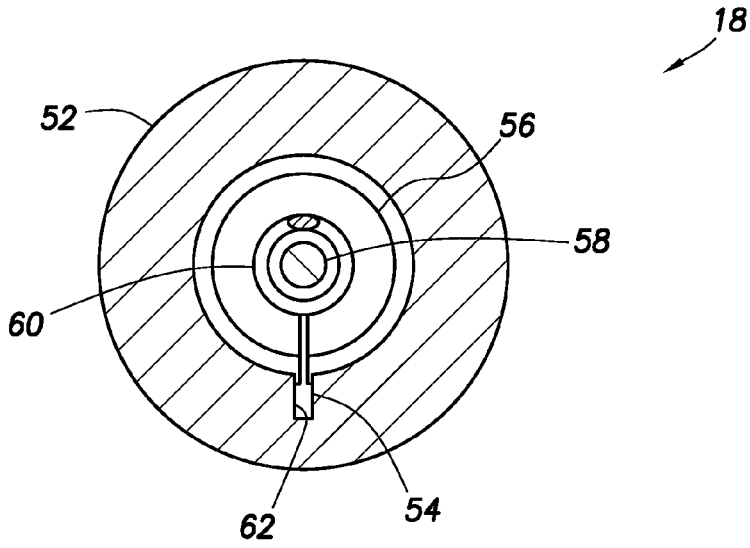
FIG. 5 is a schematic cross-sectional view of the orientation indicating device, taken along line 5-5 of FIG. 4.

A lateral cross-sectional view of the device 18 is representatively illustrated in FIG. 5. In this view, the manner in which the eccentric weight 54 may be azimuthally aligned with the recess 62 can be clearly seen.

The eccentric weight 54 is "eccentric" in that its weight is radially offset from an axis of rotation 66 (see FIG. 4) about which the eccentric weight rotates on the spindle 58. In this embodiment, the axis of rotation 66 also corresponds to an axis of rotation of the tubular string 16 in the wellbore 14 in the system 10.

Since the eccentric weight 54 is radially offset from the axis of rotation 66, the weight will be biased by gravitational force to its lowest position relative to the axis of rotation at all times the axis is not precisely vertical. Thus, in deviated wellbores, the eccentric weight 54 will seek a lowermost position in the device 18, regardless of the azimuthal orientation of the device 18 and the tubular string 16.

Since the flow area through the passage 44 cannot be increased unless the eccentric weight 54 is aligned with the recess 62, it follows that the flow area through the passage 44 cannot be increased unless the recess is also at a lowermost position in the device 18. Thus, by aligning the recess 62 relative to a desired orientation of a structure (such as the structures 12, 22, 24), the desired orientation of the structure can be indicated by the increased flow area through the passage 44 (observed as a reduced pressure differential across the device 18).

Figure 6:
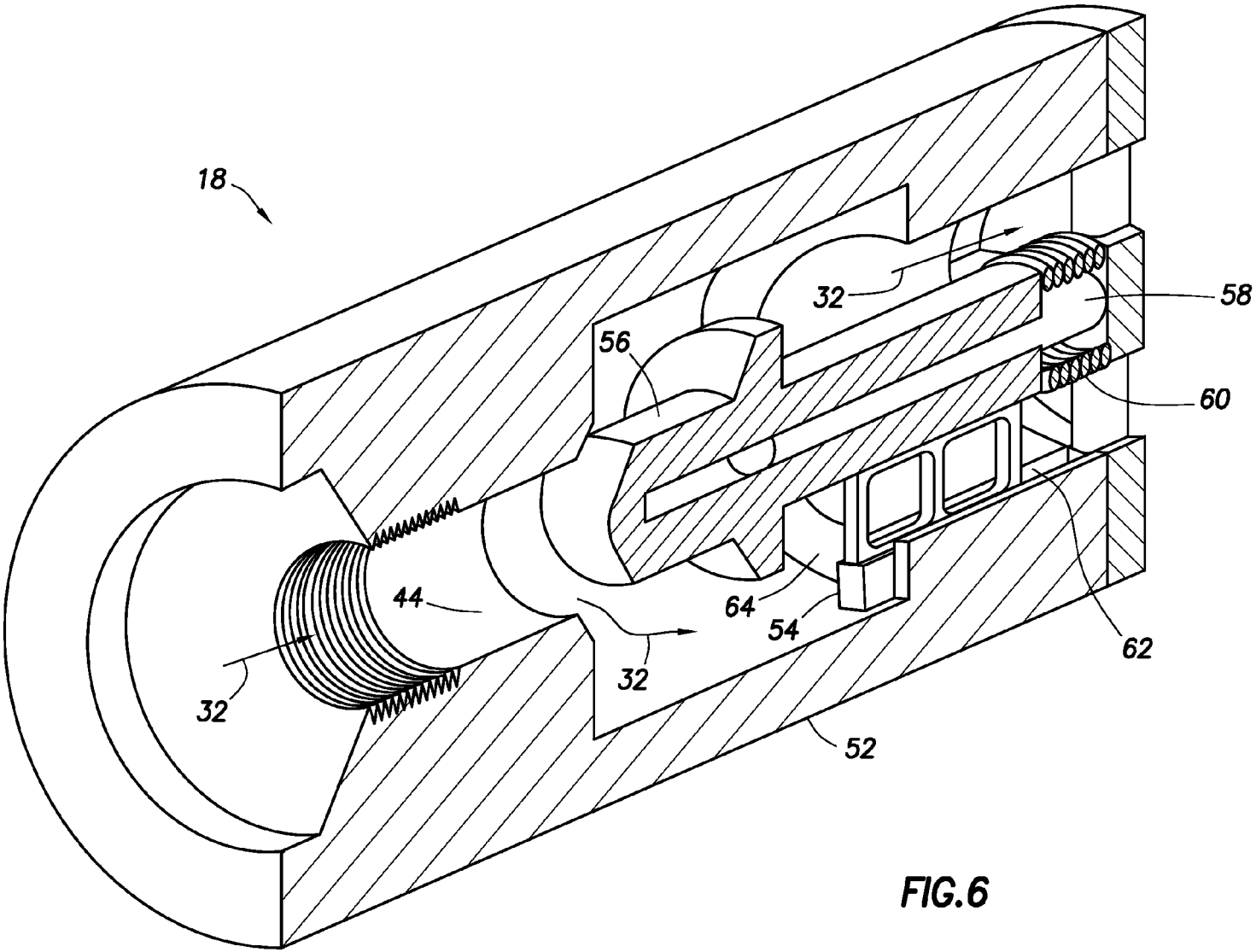
FIG. 6 is a schematic cross-sectional perspective view of the orientation indicating device in the relatively less flow restricting configuration.

An isometric cross-sectional view of the device 18 is representatively illustrated in FIG. 6. In this view, the eccentric weight 54 is depicted as being received in the recess 62, and the eccentric weight and flow restrictor 56 being displaced by flow of the fluid 32, so that the flow area of the passage 44 is increased, thereby reducing the pressure differential across the device 18.

If the device 18 is the most flow restrictive element in the circulation flowpath of the fluid 32 when the flow area through the passage 44 is restricted as depicted in FIG. 4, then the reduced pressure differential across the device due to the increased flow area through the passage as depicted in FIG. 6 will be easily observable at a remote location. For example, the difference between pressure applied at the surface to circulate the fluid 32 at a certain flow rate, and pressure in the return flowpath of the fluid at the surface can be readily monitored for changes in the pressure differential. As will be readily appreciated by those skilled in the art, greater applied pressure will be required to circulate the fluid 32 at a certain flow rate when the flow area through the passage 44 is more restricted, and less applied pressure will be required to circulate the fluid at the same flow rate when the flow area through the passage is less restricted.

In practice, the method of utilizing the device 18 to indicate orientation of a structure in a wellbore is very uncomplicated and convenient to perform. The method will be explained below with reference to the system 10 of FIG. 1, but it should be clearly understood that the method may be used with a variety of different systems, and variations in the method may be used, in keeping with the principles of the present disclosure.

Initially, the device 18 is azimuthally aligned with the structure (such as structure 12, 22 and/or 24) for which indication of orientation in the wellbore 14 is desired. In this example, the recess 62 would be oriented 180 degrees from the window 12, since the indication of orientation is desired when the window is vertically upward relative to the wellbore 14.

This azimuthal alignment of the recess 62 relative to the window 12 can be easily achieved using the alignment device 20 or any other suitable alignment device. Similarly, the recess 62 can be azimuthally aligned with the structures 22, 24 using the alignment devices 20.

Alternatively, if use of the alignment devices 20 is not desired or available, a recording of the relative azimuthal orientation between the recess 62 and each of the structures 12, 22 and/or 24 can be made when the device 18 is interconnected in the tubular string 16. In this manner, the orientation of each of the structures 12, 22 and/or 24 will be known when the downward orientation of the recess 62 is indicated by the reduced pressure differential across the device 18.

After the device 18 has been interconnected in the tubular string 16 and the relative orientation between the recess 62 and the structures 12, 22 and/or 24 is suitably adjusted, or at least known, the tubular string is conveyed into the wellbore 14. Note that these steps may be performed concurrently, for example, if the length of the tubular string 16 between the device 18 and structures 12, 22 and/or 24 is too great to permit them to be simultaneously installed in the well.

When the tubular string 16 is at the desired depth in the wellbore 14, the fluid 32 is circulated at a certain flow rate, and the observed pressure differential is noted. Circulation is then ceased, and the tubular string 16 is rotated an incremental amount in the wellbore 14. The fluid 32 is again circulated at the same flow rate, and the observed pressure differential is noted.

These steps of ceasing circulation, rotating the tubular string 16 an incremental amount, and then circulating the fluid 32 at a certain flow rate, are repeated until a decrease in the pressure differential across the device 18 is observed. At that point, the azimuthal orientation of the device 18 is known and, therefore, the azimuthal orientation of each of the structures 12, 22 and/or 24 is also known.

Further rotation of the tubular string 16 may be desired, for example, to achieve another azimuthal orientation of the structure 12, 22 and/or 24, to compensate for stored torque in the tubular string 16 or work string 26, to compensate for friction between the wellbore 14 and the tubular string 16 or work string 26, etc. In addition, the tubular string 16 may be reciprocated in the wellbore 14 after each incremental rotation, for example, to alleviate the effects of stored torque in the tubular string 16 or work string 26, and friction between the wellbore 14 and the tubular string 16 or work string 26, etc. Thus, it will be appreciated that variations in the method can be used in keeping with the principles of the present disclosure.

After the tubular string 16 and each of the structures 12, 22, 24 have been properly oriented, the cement 46 can be flowed through the device 18, cementing valve 38 and shoe 40, and into the annulus 42. In this example, the device 18 is configured to conveniently receive a dart in the housing assembly 52 to close off the passage 44 at the conclusion of the cement pumping operation. After the cement 46 has sufficiently cured, the device 18, cementing valve 38 and shoe 40 may be drilled through (as depicted in FIG. 3), in order to extend the wellbore 14.

Figure 7:
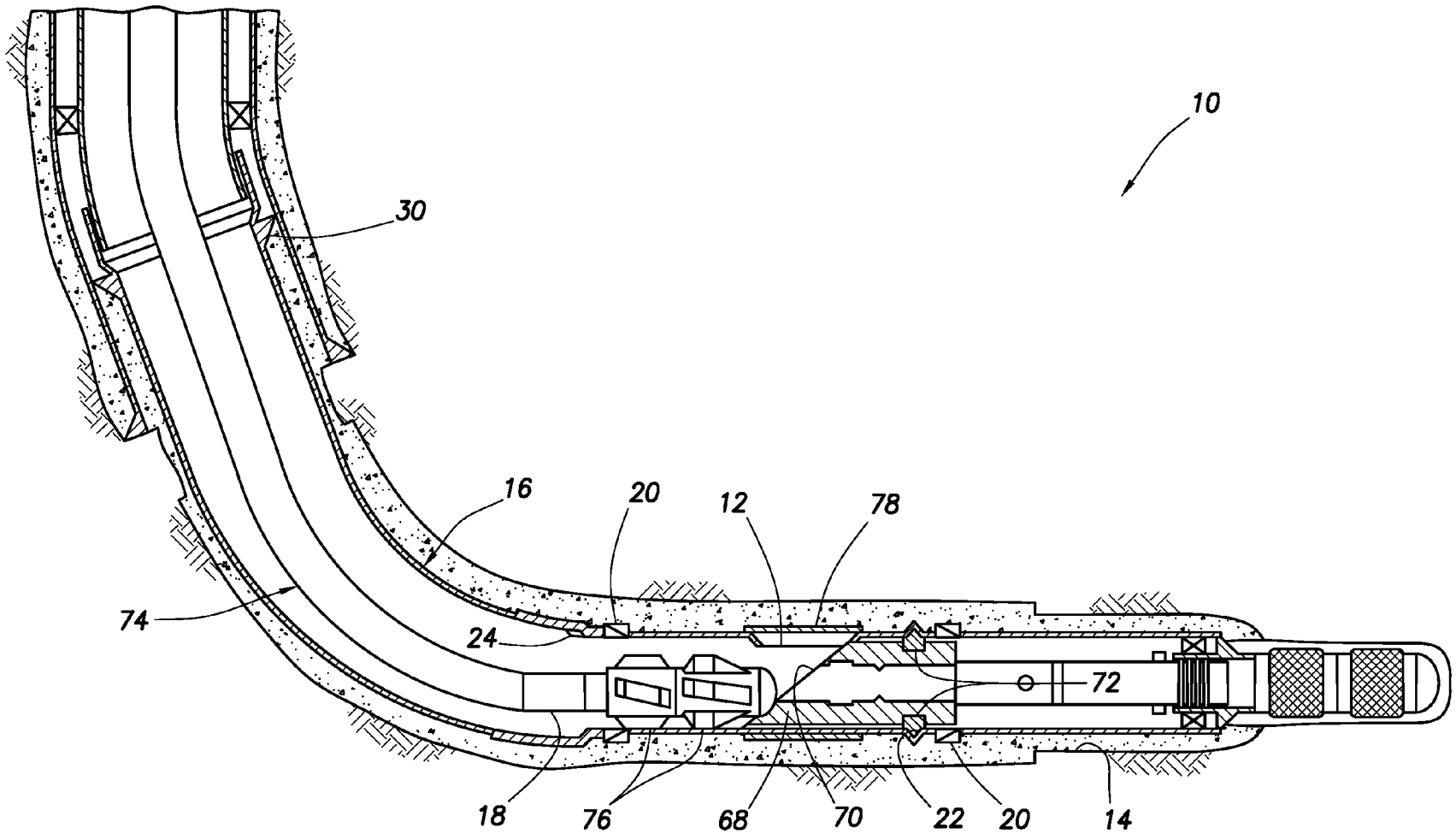
FIG. 7 is a schematic cross-sectional view of a whipstock orientation system and method which embody principles of the present disclosure.
Figure 8:
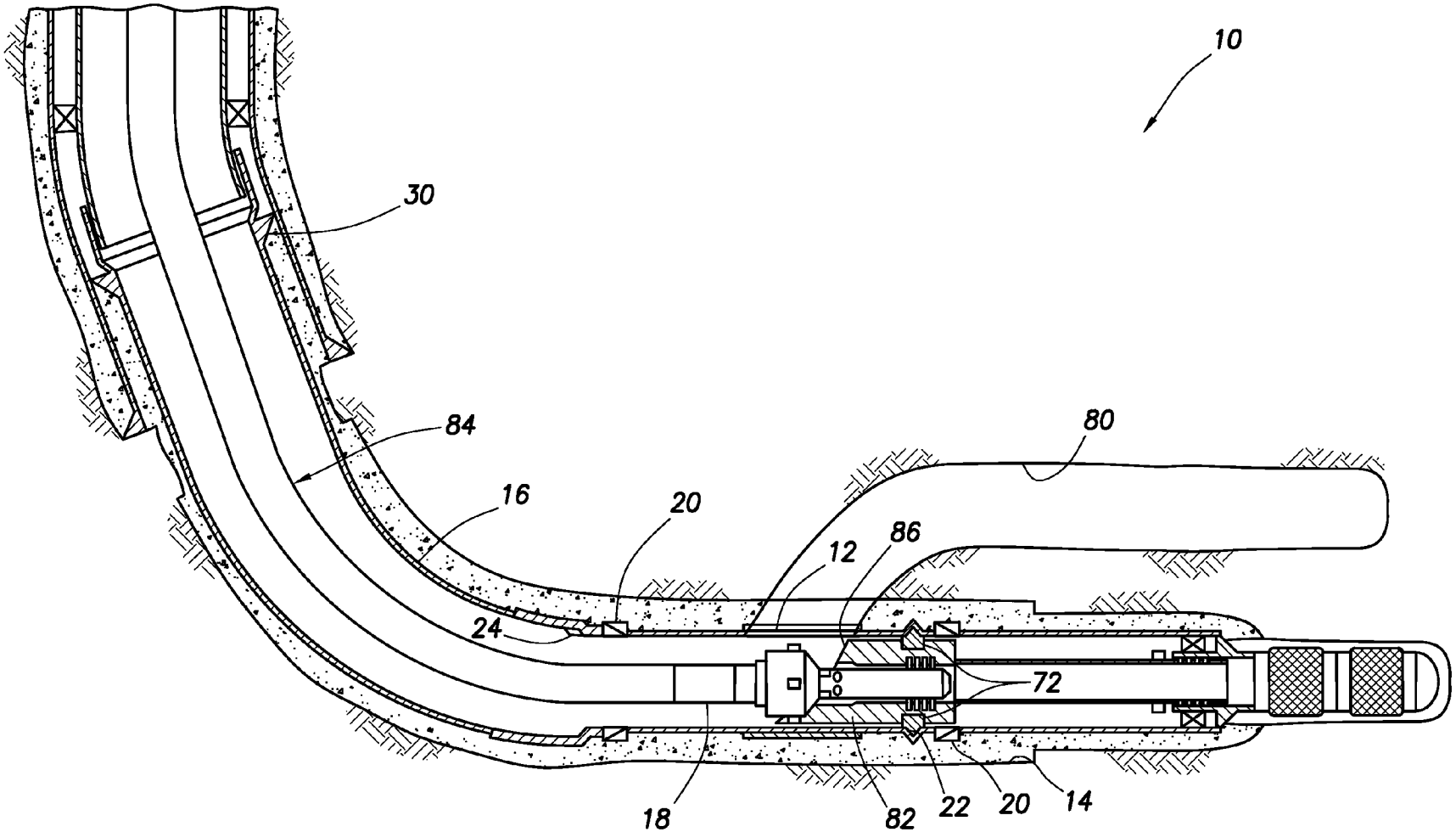
FIG. 8 is a schematic cross-sectional view of a deflector orientation system and method which embody principles of the present disclosure.
Figure 9:
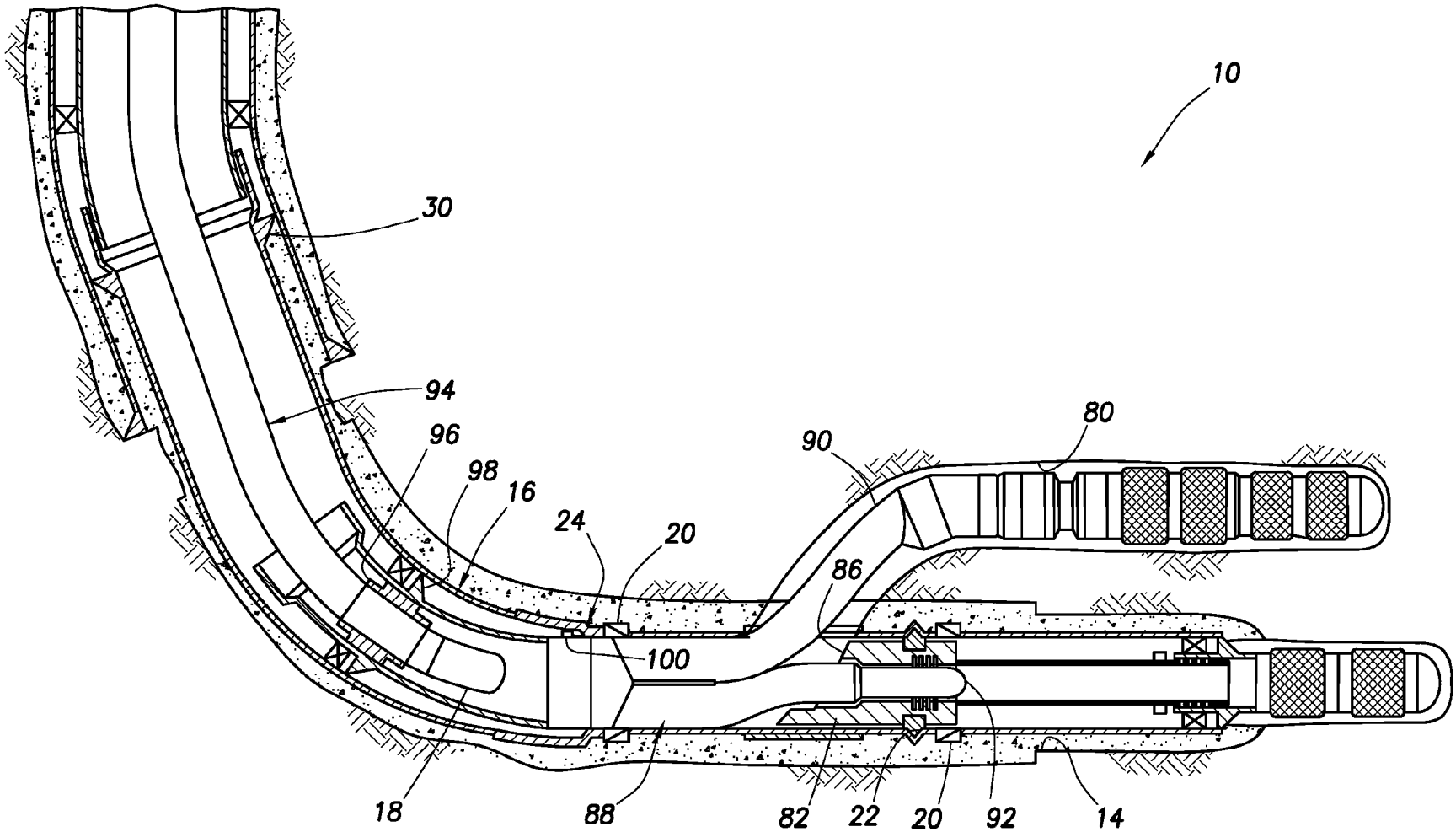
FIG. 9 is a schematic cross-sectional view of a completion assembly orientation system and method which embody principles of the present disclosure.

Referring additionally to FIGS. 7-9, additional operations in the system 10 are representatively illustrated to demonstrate additional uses for the device 18. Of course, many other uses for the device 18 are possible, and so the principles of this disclosure should not be interpreted as being limited to only the uses described herein.

In FIG. 7, a window milling whipstock 68 has been conveyed into the tubular string 16. An inclined upper deflection face 70 of the whipstock 68 is azimuthally aligned with the window 12 as a result of cooperative engagement between the latch profile 22 and latch members 72 attached to the whipstock. In this example, the relative azimuthal orientation between the latch members 72 and the deflection face 70 can be adjusted as desired, so that if the azimuthal orientation of the latch profile 22 relative to the wellbore 14 is known, the azimuthal orientation of the deflection face relative to the wellbore (and the window 12) when the latch members cooperatively engage the latch profile can be adjusted as desired.

In some situations, a preformed window 12 may not be used. In those situations, it is not necessary to azimuthally align the deflection face 70 with any window, since the window will be created in the tubular string 16 as a result of the milling process.

A device 18 is interconnected as part of a work string 74 used to convey the whipstock 68 and mills 76 into the tubular string 16. The device 18 is used to indicate appropriate azimuthal orientation of the deflection face 70 on the whipstock 68 relative to the wellbore 14.

Similar to the method described above for indicating orientation of the tubular string 16, desired orientation of the whipstock 68 is indicated by appropriately orienting (or at least noting the orientation of) the device 18 relative to the whipstock prior to or during conveyance of the whipstock, mills 76 and device into the well. When the whipstock 68 is at or near its desired position in the tubular string 16, fluid is circulated through the work string 74 at a certain flow rate, the pressure differential across the device 18 is noted, circulation is ceased, and the work string is incrementally rotated. These steps are repeated until a reduction in the pressure differential indicates that the device is at a known azimuthal orientation relative to the wellbore 14.

As described above, further rotation of the work string 74 may be used, and the work string may be reciprocated between incremental rotations, if desired. Once the desired orientation of the deflection face 70 is achieved, the latch members 72 may be cooperatively engaged with the latch profile 22.

Alternatively, fluid may be circulated through the work string 74 at a certain flow rate and the pressure differential across the device 18 may be noted prior to the latch members 72 being engaged with the latch profile 22, and then fluid may again be circulated through the work string at the same flow rate and the pressure differential across the device noted, in order to confirm that that the pressure differential is reduced as an indication that the deflection face 70 is in the desired azimuthal orientation when the latch members are engaged with the latch profile.

Thus, it will be appreciated that the device 18 may be used to indicate azimuthal orientation of any structure relative to a wellbore prior to, during and/or after the structure is at a desired azimuthal orientation. As long as the relative orientation between the device 18 and the structure is known, the device can be used to achieve any desired azimuthal orientation of the structure relative to a deviated wellbore and/or any other structure in the wellbore.

With the whipstock 68 appropriately oriented as depicted in FIG. 7, the mills 76 can be detached from the whipstock and the deflection face 70 will deflect the mills to cut through an outer sleeve 78 covering the window 12. As described above, if the window 12 is not preformed in the tubular string 16, then the milling operation can be used to cut the window through a sidewall of the tubular string. The device 18 is retrieved with the work string 74 from the well after the milling operation.

Referring additionally now to FIG. 8, another example of a use of the device 18 in the system 10 is representatively illustrated. In this example, the system 10 is depicted after a branch wellbore 80 has been drilled outward from the window 12. The whipstock 68 or another deflector may have been used to deflect a drill bit (not shown) through the window to drill the branch wellbore 80, and then the whipstock has been retrieved from the well.

As depicted in FIG. 8, another deflector 82 is being conveyed into the tubular string 16 by a work string 84. A device 18 is interconnected in the work string 84 and is used to indicate or confirm azimuthal orientation of a deflection face 86 on the deflector 82 relative to the window 12 and wellbore 14. This process is the same as, or at least substantially similar to, the process described above for orientation of the whipstock 68 of FIG. 7.

Referring additionally now to FIG. 9, yet another example of a use of the device 18 in the system 10 is representatively illustrated. In this example, the system 10 is depicted during installation of a completion assembly 88 in the wellbores 14, 80.

The completion assembly 88 includes two tubular legs 90, 92, and it is desired to deflect one leg 90 off of the deflection face 86 and into the branch wellbore 80. The other leg 92 should be received in a seal bore of the deflector 82 in the wellbore 14.

The completion assembly 88 is conveyed into the tubular string 16 by a work string 94. The work string 94 has a device 18 and a setting tool 96. The setting tool 96 is used to set a hanger 98 at an upper end of the completion assembly 88.

In a manner similar to that described above for indicating or confirming azimuthal orientation of the whipstock 68 and the deflector 82, the device 18 in the system 10 as depicted in FIG. 9 may be used to indicate or confirm orientation of the completion assembly 88 relative to the wellbore 14, alignment tool 24, deflection face 86 and window 12. Thus, prior to the leg 90 contacting the deflection face 86, the completion assembly 88 can be appropriately oriented in the wellbore 14, by alternately circulating fluid through the work string 94 at a certain flow rate and incrementally rotating the work string.

When the completion assembly 88 is in the desired azimuthal orientation, the completion assembly can be further inserted into the tubular string 16, so that the leg 90 is appropriately deflected off of the face 86, through the window 12 and into the branch wellbore 80. Eventually, the leg 92 will enter the seal bore of the deflector 82, and an alignment lug 100 on the completion assembly 88 will cooperatively engage the alignment tool 24.

Confirmation that the completion assembly 88 has been correctly installed and oriented can be obtained by circulating fluid through the work string 94 at the same flow rate as previously circulated, to ensure that the pressure differential across the device 18 is still at a reduced level. The setting tool 96 may then be used to set the hanger 98, and the device 18 along with the remainder of the work string 94 may be retrieved from the well.

Note that setting the hanger 98 may include installing a plug (such as a ball, dart, etc.) into the setting tool 96 and applying pressure via the work string 94. If the device 18 is interconnected above the setting tool 96 in the work string 94, it is a particular benefit of the device's design that the plug may be displaced through the device when the flow area through the passage 44 is increased.

In each of the above examples of uses of the device 18 in the system 10, the pressure differential across the device during the orienting process has been described in relative terms as being increased or decreased. However, it will be appreciated that it is not necessary for there to be only two levels of pressure differential across the device corresponding to two flow areas through the passage 44. Instead, there may be more than two such levels of pressure differentials and flow areas.

These multiple levels of pressure differentials and flow areas may be used to indicate not only whether the device 18 is or is not in a particular azimuthal orientation, but also whether the device is approaching or departing the particular azimuthal orientation, and by what amount the azimuthal orientation of the device differs from the particular azimuthal orientation.

Figure 10:
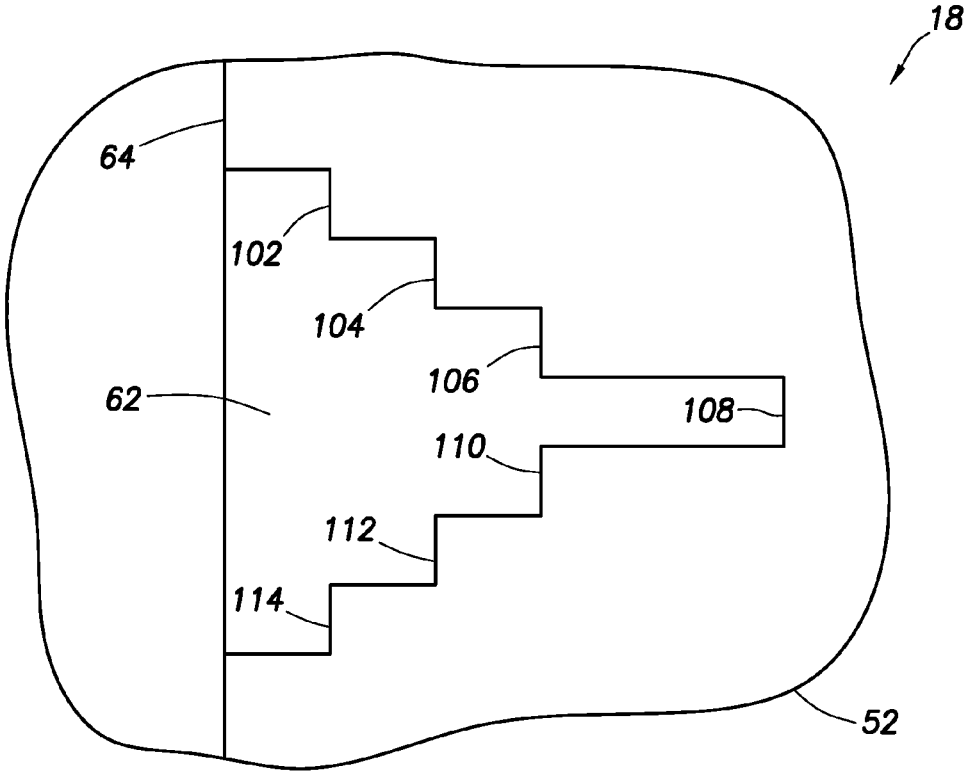
FIG. 10 is a schematic plan view of an alternate configuration of a portion of the orientation indicating device, taken from line 10-10 of FIG. 4.

For example, representatively illustrated in FIG. 10 is an alternate configuration of the recess 62, in which the recess is incrementally stepped inward from the shoulder 64. Thus, the eccentric weight 54 can engage any of multiple shoulders 102, 104, 106, 108, 110, 112, 114 in the recess 62, instead of merely engaging or not engaging the recess.

With a corresponding appropriate configuration of the flow restrictor 56 and passage 44 (such as a conical or stepped shape of these elements, etc.), engagement of the eccentric weight with the different shoulders 102, 104, 106, 108, 110, 112, 114 will produce respective different flow areas through the passage and corresponding different pressure differentials across the device 18 at a certain flow rate. Note that it is not necessary for the shoulders 102, 104, 106, 108, 110, 112, 114 to be of the same shape or size, and indeed different shapes and sizes of the shoulders may be used to produce unique respective different flow areas through the passage and corresponding different pressure differentials across the device 18 at a certain flow rate.

In one manner of using the alternate configuration of FIG. 10 in the system 10, the fluid 32 may be circulated through the device 18 at a certain flow rate and the device may be incrementally rotated along with a structure to be oriented in the wellbore 14. These steps would preferably (although not necessarily) be performed alternately as described above.

As the steps are repeated, an incremental decrease in the pressure differential across the device 18 as the device is rotated would indicate that the particular or desired orientation of the device is being approached (as the eccentric weight 54 engages the shoulders 102, 104, 106, 108 or 114, 112, 110, 108 in succession). An incremental increase in the pressure differential across the device 18 as the device is rotated would indicate that the device is moving farther from the particular or desired orientation. The level of the pressure differential across the device 18 would provide an indication of the amount by which the azimuthal orientation of the device differs from the particular or desired azimuthal orientation.

It may now be fully appreciated that the above disclosure provides many advancements in the art of azimuthally orienting structures in wellbores. In particular, the device 18, system 10 and associated methods provide for convenient, economical and accurate azimuthal orientation of various types of structures in deviated wellbores. One benefit of use of the device 18 is that the pressure differentials observed as indications of the orientation of the device are substantially constant, instead of being in the nature of pressure pulses which can be severely attenuated in deep wells.

The above disclosure provides a method of detecting orientation of a structure 12, 22, 24, 68, 82 and/or 88 in a subterranean wellbore 14. The method includes the steps of: flowing fluid 32 at a selected flow rate through an orientation indicating device 18 interconnected to the structure; and observing a substantially constant pressure differential across the device during the flowing step, thereby indicating that the structure is at a predetermined azimuthal orientation.

The method may further include the steps of: flowing fluid 32 at the selected flow rate through the device 18 interconnected to the structure while the structure is not at the azimuthal orientation; and observing a substantially constant pressure differential across the device which is different from the reduced pressure differential, thereby indicating that the structure is not at the azimuthal orientation.

The flowing step may include flowing the fluid 32 through a tubular string 16, 74, 84 and/or 94 interconnected to the device 18, and the first pressure differential may be observed as a certain pressure applied to the tubular string at a location (such as the earth's surface or a subsea location, etc.) remote from the device.

The flowing step may include flowing the fluid 32 through a tubular string 74, 84 and/or 94 interconnected to the structure 68, 82 and/or 88, and may further include the step of retrieving the device 18 from the well with the device attached to the tubular string.

The method may include any of the steps of drilling through the device 18 after the observing step, flowing cement 46 through the device 18 after the observing step, displacing a plug through the device 18 after the observing step, and interconnecting the device in a tubular string 16 between the structure 12, 22 and/or 24 and a cementing float valve 38.

The observing step may include observing multiple different substantially constant pressure differentials as the structure 12, 22, 24, 68, 82 and/or 88 approaches the azimuthal orientation. Flow of the fluid 32 may be stopped between observation of each of the different pressure differentials.

Also provided by the above disclosure is a system 10 for indicating orientation of a structure 12, 22, 24, 68, 82 and/or 88 in a subterranean wellbore 14. The system 10 may include an orientation indicating device 18 responsive to fluid flow through the device, whereby fluid flow through the device at a selected flow rate produces a reduced pressure differential across the device when the device is at a preselected azimuthal orientation, compared to an increased pressure differential across the device produced by fluid flow through the device at the selected flow rate when the device is not at the azimuthal orientation.

The device 18 may be interconnected to the structure 12, 22, 24, 68, 82 and/or 88 in the wellbore 14, such that the azimuthal orientation of the device corresponds to a azimuthal orientation of the structure. The device 18 may be interconnected in a tubular string 16 between the structure and a cementing float valve 38. The device 18 may be interconnected to a tubular string 16, 74, 84 and/or 94 used to convey and position the structure in the wellbore.

The device 18 may include a flow restrictor 56 and an eccentric weight 54, whereby displacement of the eccentric weight in response to varied orientation of the device produces varied restriction to flow through a passage 44 of the device. The eccentric weight 54 may prevent increasing of a flow area through the passage 44 until the device 18 is at the azimuthal orientation.

The device 18 may further include a recess 62, whereby the eccentric weight 54 is received in the recess to thereby permit the flow area through the passage 44 to increase when the device is at the azimuthal orientation. The recess 62 may be stepped to thereby provide multiple increments of receiving the weight in the recess, whereby the flow area through the passage 44 is permitted to incrementally increase as the device 18 approaches the azimuthal orientation.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of indicating orientation of a structure in a subterranean wellbore, the method comprising the steps of:

flowing fluid at a selected flow rate through an orientation indicating device interconnected to the structure;

observing a first substantially constant pressure differential across the device throughout the flowing step, thereby indicating that the structure is at a predetermined azimuthal orientation;

flowing fluid at the selected flow rate through the device while the structure is not at the predetermined azimuthal orientation; and observing a second substantially constant pressure differential across the device which is different from the first pressure differential, thereby indicating that the structure is not at the predetermined azimuthal orientation.

2. The method of claim 1, wherein the flowing step further comprises flowing the fluid through a tubular string interconnected to the device, and wherein the first pressure differential is observed as a pressure applied to the tubular string at a location remote from the device.

3. The method of claim 1, wherein the flowing step further comprises flowing the fluid through a tubular string interconnected to the structure, and further comprising the step of retrieving the device from the well with the device attached to the tubular string.

4. The method of claim 1, further comprising the step of drilling through the device after the observing step.

5. The method of claim 1, further comprising the step of flowing cement through the device after the observing step.

6. The method of claim 1, further comprising the step of displacing a plug through the device after the observing step.

7. The method of claim 1, further comprising the step of interconnecting the device in a tubular string between the structure and a cementing float valve.

8. The method of claim 1, wherein the observing step further comprises observing multiple different substantially constant pressure differentials as the structure approaches the predetermined azimuthal orientation.

9. The method of claim 8, wherein flow of the fluid is stopped between observation of each of the multiple different pressure differentials.

10. A system for indicating orientation of a structure in a subterranean wellbore, the system comprising:

an orientation indicating device, whereby a fluid flow at a selected flow rate through a flow passage of the device produces a substantially constant reduced pressure differential across the device throughout the fluid flow as an indication that the device is at a preselected azimuthal orientation, and whereby a valve at least partially blocks the flow passage when the device is not at the preselected azimuthal orientation, wherein the fluid flow produces a substantially constant increased pressure differential across the device throughout the fluid flow as an indication that the device is not at the preselected azimuthal orientation.

11. The system of claim 10, wherein the device is interconnected to the structure in the wellbore, such that the preselected azimuthal orientation of the device corresponds to an azimuthal orientation of the structure.

12. The system of claim 11, wherein the device is interconnected in a tubular string between the structure and a cementing float valve.

13. The system of claim 11, wherein the device is interconnected to a tubular string used to convey and position the structure in the wellbore.

14. The system of claim 10, wherein the device includes a flow restrictor and an eccentric weight, whereby displacement of the eccentric weight in response to varied orientation of the device produces varied restriction to flow through a passage of the device.

15. The system of claim 14, wherein the eccentric weight prevents increasing of a flow area through the passage until the device is at the preselected azimuthal orientation.

16. The system of claim 14, wherein the device further includes a recess, whereby the eccentric weight is received in the recess to thereby permit the flow area through the passage to increase when the device is at the preselected azimuthal orientation.

17. The system of claim 16, wherein the recess is stepped to thereby provide multiple increments of receiving the weight in the recess, whereby the flow area through the passage is permitted to incrementally increase as the device approaches the preselected azimuthal orientation.

* * * * *